US008800855B2

(12) United States Patent
Fitzwater

(10) Patent No.: US 8,800,855 B2
(45) Date of Patent: Aug. 12, 2014

(54) CARTON WITH SLIDABLE OPENER

(71) Applicant: Graphic Packaging International, Inc., Atlanta, GA (US)

(72) Inventor: Kelly R. Fitzwater, Lakewood, CO (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 13/923,416

(22) Filed: Jun. 21, 2013

(65) Prior Publication Data

US 2013/0277421 A1 Oct. 24, 2013

Related U.S. Application Data

(63) Continuation of application No. PCT/US2012/022872, filed on Jan. 27, 2012.

(60) Provisional application No. 61/462,092, filed on Jan. 28, 2011.

(51) Int. Cl.
*B65D 17/32* (2006.01)
*B65D 5/70* (2006.01)

(52) U.S. Cl.
USPC ..... 229/220; 229/129.1

(58) Field of Classification Search
CPC . B65D 5/646; B65D 5/723; B65D 2517/0017
USPC ..... 229/129.1, 130, 131.1, 220
See application file for complete search history.

(56) References Cited

U.S. PATENT DOCUMENTS

| | | | | |
|---|---|---|---|---|
| 1,951,274 | A * | 3/1934 | Denman | 229/131.1 |
| 3,033,436 | A * | 5/1962 | Peimer | 229/220 |
| 3,040,953 | A * | 6/1962 | Tindall | 229/220 |
| 3,894,680 | A | 7/1975 | Araki | |
| 4,081,128 | A * | 3/1978 | O'Neill | 229/220 |
| 4,197,985 | A * | 4/1980 | Austin | 229/220 |
| 4,201,329 | A * | 5/1980 | Roccaforte | 229/131.1 |
| 4,609,142 | A * | 9/1986 | Adamek | 229/220 |
| 5,429,297 | A * | 7/1995 | Walsh | 229/220 |
| 5,810,250 | A | 9/1998 | Stone et al. | |
| 5,875,962 | A * | 3/1999 | Jørgensen-Beck et al. | 229/220 |
| 6,213,388 | B1 | 4/2001 | Ours et al. | |
| 6,945,449 | B2 | 9/2005 | Hengami | |

(Continued)

OTHER PUBLICATIONS

International Search Report and Written Opinion for PCT/US2012/022872 dated Sep. 3, 2012.

*Primary Examiner* — Gary Elkins
(74) *Attorney, Agent, or Firm* — Womble Carlyle Sandridge & Rice, LLP

(57) ABSTRACT

A carton for containing a product. The carton comprises a plurality of panels that extends at least partially around an interior of the carton. The plurality of panels comprises a first end panel, a first side panel, a second end panel, and a second side panel. At least one end flap is respectively foldably connected to a respective panel of the plurality of panels. The at least one end flap at least partially forms a closed end of the carton. An opener is positionable between a closed position substantially preventing removal of the product from the interior of the carton through a dispenser opening in one of the first end panel and the second end panel, and an open position allowing removal of the product from the interior of the carton through the dispenser opening.

23 Claims, 18 Drawing Sheets

(56) References Cited

U.S. PATENT DOCUMENTS 7,156,286 B2 * 1/2007 Hengami ..... 229/129.1
7,503,475 B2 * 3/2009 McGowan ..... 229/220
2004/0065723 A1 * 4/2004 Hengami ..... 229/125.12
2011/0168767 A1 * 7/2011 Hengami ..... 229/129.1

* cited by examiner

CARTON WITH SLIDABLE OPENER

CROSS-REFERENCE TO RELATED APPLICATION

This application is a continuation application of PCT/US2012/022872, filed Jan. 27, 2012, which application claims the benefit of U.S. Provisional Patent Application No. 61/462,092, filed Jan. 28, 2011.

INCORPORATION BY REFERENCE

The disclosures of PCT/US2012/022872, which was filed on Jan. 27, 2012, and U.S. Provisional Patent Application No. 61/462,092, which was filed on Jan. 28, 2011, are hereby incorporated by reference for all purposes as if presented herein in its entirety.

BACKGROUND OF THE DISCLOSURE

The present disclosure generally relates to cartons having a slidable opener.

SUMMARY OF THE DISCLOSURE

In general, one aspect of the disclosure is generally directed to a carton for containing a product. The carton comprises a plurality of panels that extends at least partially around an interior of the carton. The plurality of panels comprises a first side panel, a first end panel, a second side panel, and a second end panel. An opener is in at least one of the first end panel and the second end panel and is slidably moveable between an open position and a closed position.

In another aspect, the disclosure is generally directed to a carton for containing a product. The carton comprises a plurality of panels that extends at least partially around an interior of the carton. The plurality of panels comprises a first end panel, a first side panel, a second end panel, and a second side panel. At least one end flap is respectively foldably connected to a respective panel of the plurality of panels. The at least one end flap at least partially forms a closed end of the carton. An opener is positionable between a closed position substantially preventing removal of the product from the interior of the carton through a dispenser opening in one of the first end panel and the second end panel, and an open position allowing removal of the product from the interior of the carton through the dispenser opening.

In another aspect, the disclosure is generally directed to a blank for forming a carton for containing a product. The blank comprises a plurality of panels comprising a first end panel, a first side panel, a second end panel, and a second side panel. At least one end flap is respectively foldably connected to a respective panel of the plurality of panels. The at least one end flap is for at least partially forming a closed end of the carton formed from the blank. Opening features are for forming an opener in the carton formed from the blank. The opener being positionable between a closed position substantially preventing removal of the product from carton through a dispenser opening in one of the first end panel and the second end panel, and an open position allowing removal of the product from the interior of the carton through the dispenser opening.

In another aspect, the disclosure is generally directed to a method of forming a carton. The method comprises obtaining a blank comprising a plurality of panels comprising a first end panel, a first side panel, a second end panel, and a second side panel, at least one end flap respectively foldably connected to a respective panel of the plurality of panels, and opening features for forming an opener in the carton formed form the blank. The opening features comprise a dispenser opening in one of the first end panel and the second end panel. The method further comprises forming an interior of the carton at least partially defined by the plurality of panels and positioning the at least one end flap to at least partially close an end of the interior and to at least partially form the opener from the opening features. The opener being positionable between a closed position substantially preventing removal of the product from carton through the dispenser opening in one of the first end panel and the second end panel, and an open position allowing removal of the product from the interior of the carton through the dispenser opening.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to a carton with a slidable opener that may contain products such as flowable materials or food products (e.g., cereal) or any other flowable material (e.g., powder-type mixes, granular materials, salts or other crystallines, detergents, etc.). The carton can include a liner in the carton interior. The liner can be used to protect and store product in the carton. The liner can be made from materials suitable in composition for packaging the particular product, and the materials include, but are not limited to, plastics such as PET, LDPE, LLDPE, HDPE, PP, PS, PVC, EVOH, and Nylon; and the like, or any combination thereof. Alternatively, the liner can be omitted.

For the purpose of illustration and not for the purpose of limiting the scope of the disclosure, the following detailed description describes a liner as disposed within the carton embodiments. However, the liner can be omitted without departing from the scope of the disclosure. In one or more embodiments, In this specification, the terms "lower," "bottom," "upper" and "top" indicate orientations determined in relation to fully erected and upright cartons.

Figure 1:
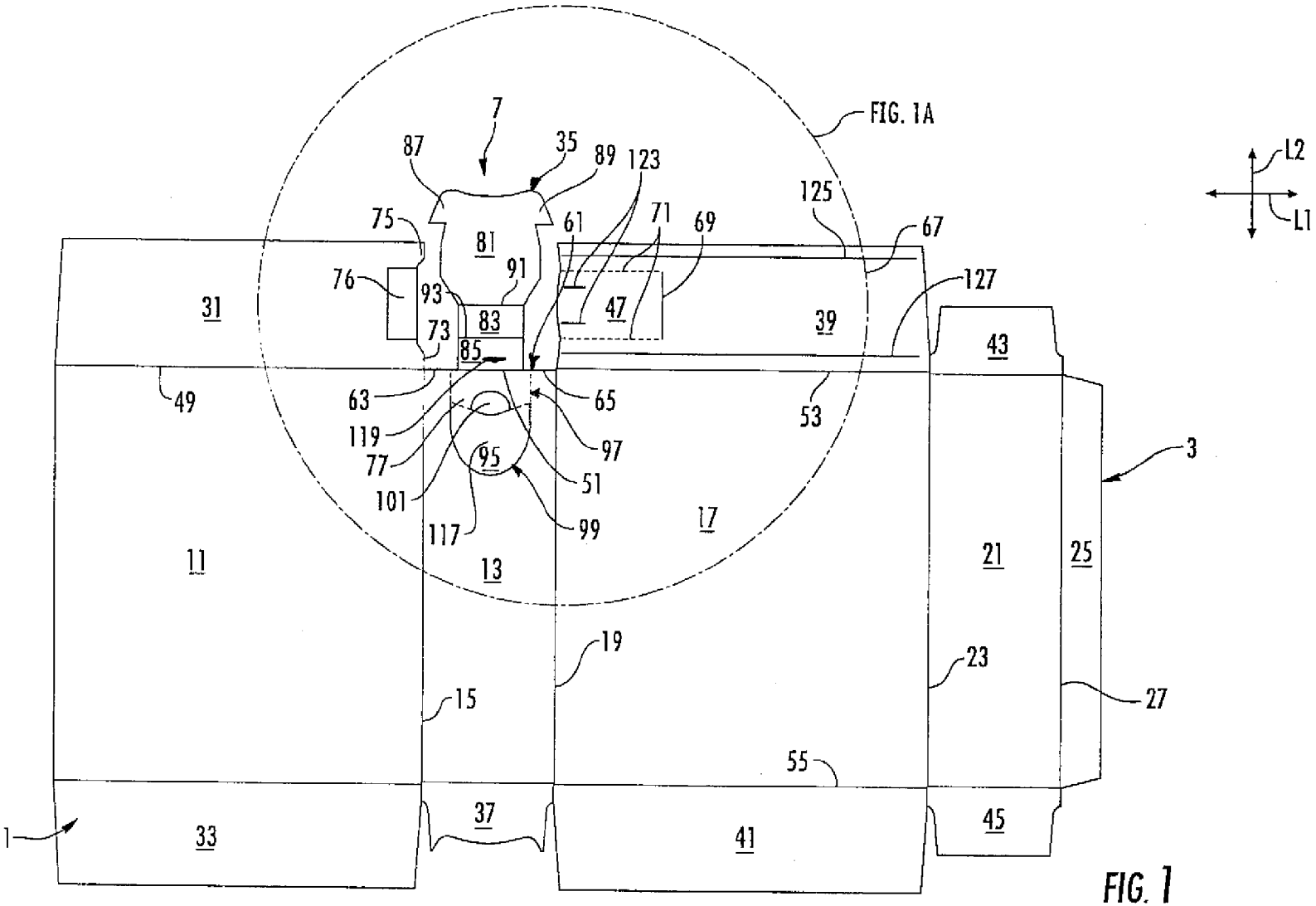
FIG. 1 is a plan view of an exterior surface of a blank for forming a carton of a first embodiment of the disclosure.

FIG. 1 is a plan view of a first, exterior side 1 of a blank 3 used to form a carton 5 (illustrated in FIG. 7) having a slidable opener 7 according to a first embodiment of the disclosure. In one embodiment, the opener 7 is positionable between a first (closed) position (FIG. 7) and a second (open) position (FIG. 10) allowing a dispensable product or flowable material (not shown) to be dispensed from the carton 5.

The blank 3 has a longitudinal axis L1 and a lateral axis L2. The blank 3 comprises a first side panel 11 foldably connected to a first end panel 13 at a first lateral fold line 15, a second side panel 17 foldably connected to the first end panel 13 at a second lateral fold line 19, and a second end panel 21 foldably connected to the second side panel 17 at a third lateral fold line 23. In the illustrated embodiment, an adhesive panel 25 is foldably connected to the second end panel 21 at a fourth lateral fold line 27.

As shown in FIG. 1, the first side panel 11 is foldably connected to a first end flap 31 and a second end flap 33. The first end panel 13 is foldably connected to a first end flap 35 and a second end flap 37. The second side panel 17 is foldably connected to a first end flap 39 and a second end flap 41. The second end panel 21 is foldably connected to first end flap 43 and a second end flap 45. The first end flap flaps 31, 35, 39, and 43 extend along a first or top marginal area of the blank 3 and form top end flaps. The top end flap 31 is foldably connected to the first side panel 11 along a first longitudinally extending fold line 49, the top end flap 35 is foldably connected to the first end panel 13 along a second longitudinally extending fold line 51, the top end flap 39 is foldably connected to the second side panel 17 along a third longitudinally extending fold line 53, and the top end flap 43 is foldably connected to second end panel 21 along the third longitudinally extending fold line 53. The bottom end flaps 33, 37, 41, 45 extend along a second or bottom marginal area of the blank 3, and may be foldably connected along a fourth longitudinally extending fold line 55.

In one embodiment, the longitudinal fold lines 49, 51, 53, 55 may be, for example, substantially straight, or offset at one or more locations to account for blank thickness or for other factors. When the carton 5 (FIG. 7) is erected, the top end flaps 31, 35, 39, and 43 close a top end 57 of the carton 5, and the bottom end flaps 33, 37, 41, 45 close a bottom end 59 of the carton 5.

In one embodiment, the first end panel 13 has a longitudinal top edge 61. In the illustrated embodiment, the top edge 61 comprises a first portion 63 extending between the fold line 15 and the end flap 35 and a second portion 65 extending between the fold line 19 and the end flap 35. In the illustrated embodiment, the end flap 35 is connected to the end panel at the fold line 51 that extends between the first portion 63 and the second portion 65 of the top edge 61.

As shown in FIG. 1, the top end flap 39 includes a first portion in the form of a hinge flap 47 that is foldably connected to a second (base) portion 67 along a lateral fold line 69. The hinge flap 47 is at least partially defined by a pair of longitudinal tear lines 71 extending across a portion of the flap 39. The tear lines 71 could be otherwise shaped, arranged, and/or configured, or the tear line could be other forms of weakening (e.g., cut line) without departing from the disclosure. In one embodiment, the hinge flap 47 is generally rectangular but it could be otherwise shaped, arranged and configured without departing from the disclosure.

As shown in FIG. 1, top end flap 31 includes a first stop protrusion 73 and a second stop protrusion 75 located generally on either side of a debossed portion 76. The first stop protrusion 73 and the second stop protrusion 75 are located at a proximal edge of the top flap 31. The stop protrusions 73, 75 could be otherwise shaped, arranged, and/or configured. The debossed portion 76 is a depressed or indented portion of the top end flap 31. In one embodiment, the debossed portion 76 is generally rectangular but the debossed portion could be otherwise shaped, arranged, configured, and/or omitted without departing from the disclosure.

As shown in FIG. 1, the opener 7 comprises the top end flap 35 and an access flap 77 in the end panel 13 that is operatively connected to the end flap 35 at the longitudinal fold line 51. In one embodiment, the end flap 35 comprises a main panel 81 at a free (distal) end of the end flap 35, a first hinge panel 83 foldably connected to the main panel 81, a second hinge panel 85 foldably connected to the first hinge panel 83. In one embodiment, the main panel 81 has a general T-shaped configuration having a first retention tab or shoulder 87 and a second retention tab or shoulder 89. In the illustrated embodiment, the first hinge panel 83 is foldably connected to the main panel 81 at a longitudinal fold line 91, and the second hinge panel 85 is foldably connected to the first hinge panel 83 at a longitudinal fold line 93 and the access flap 77 at the longitudinal fold line 51. The top end flap 35 could be otherwise shaped, arranged, and/or configured without departing from the disclosure.

Figure 7:
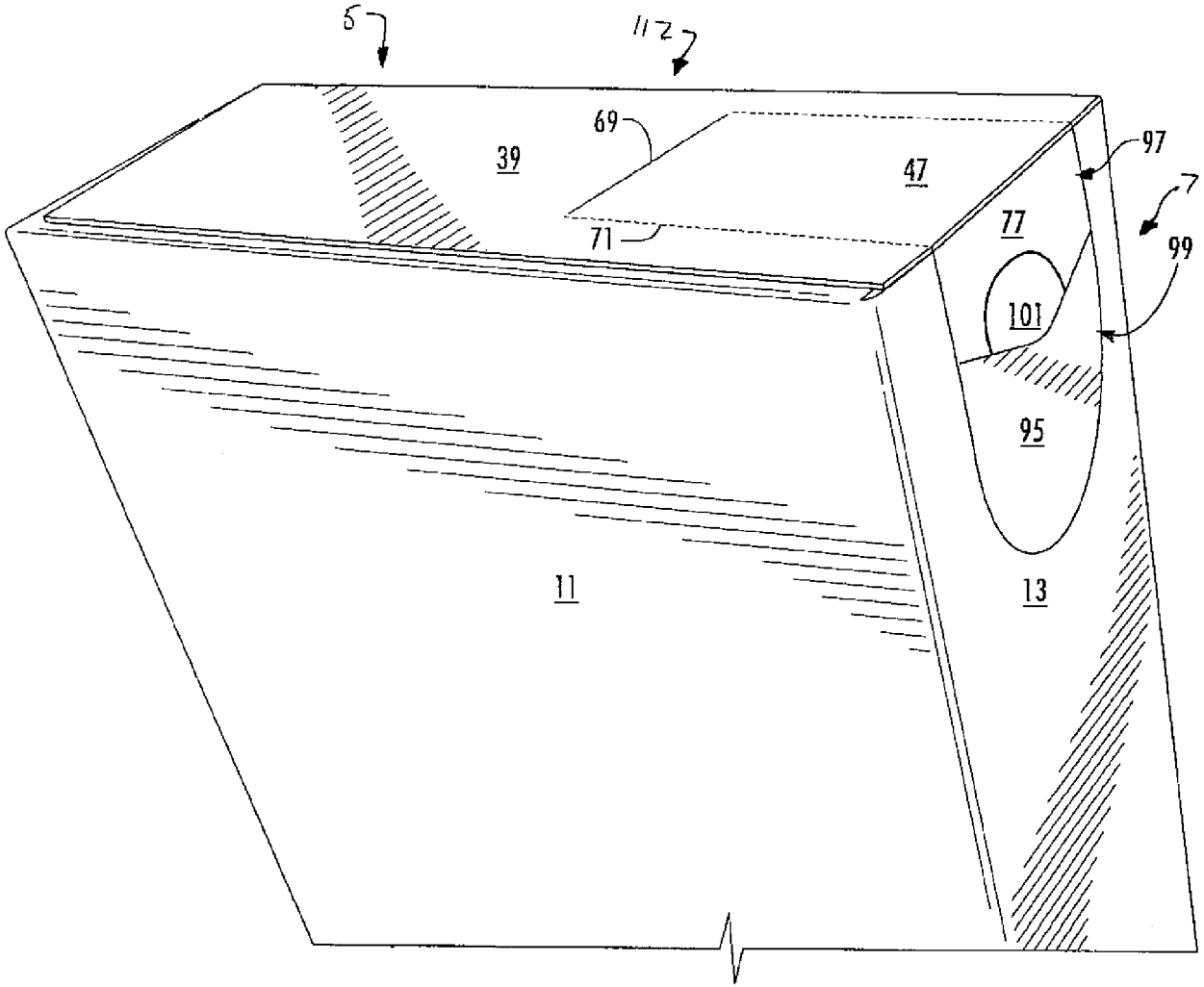
FIG. 7 is a top view of the carton of the first embodiment with an opener in a closed position.
Figure 8:
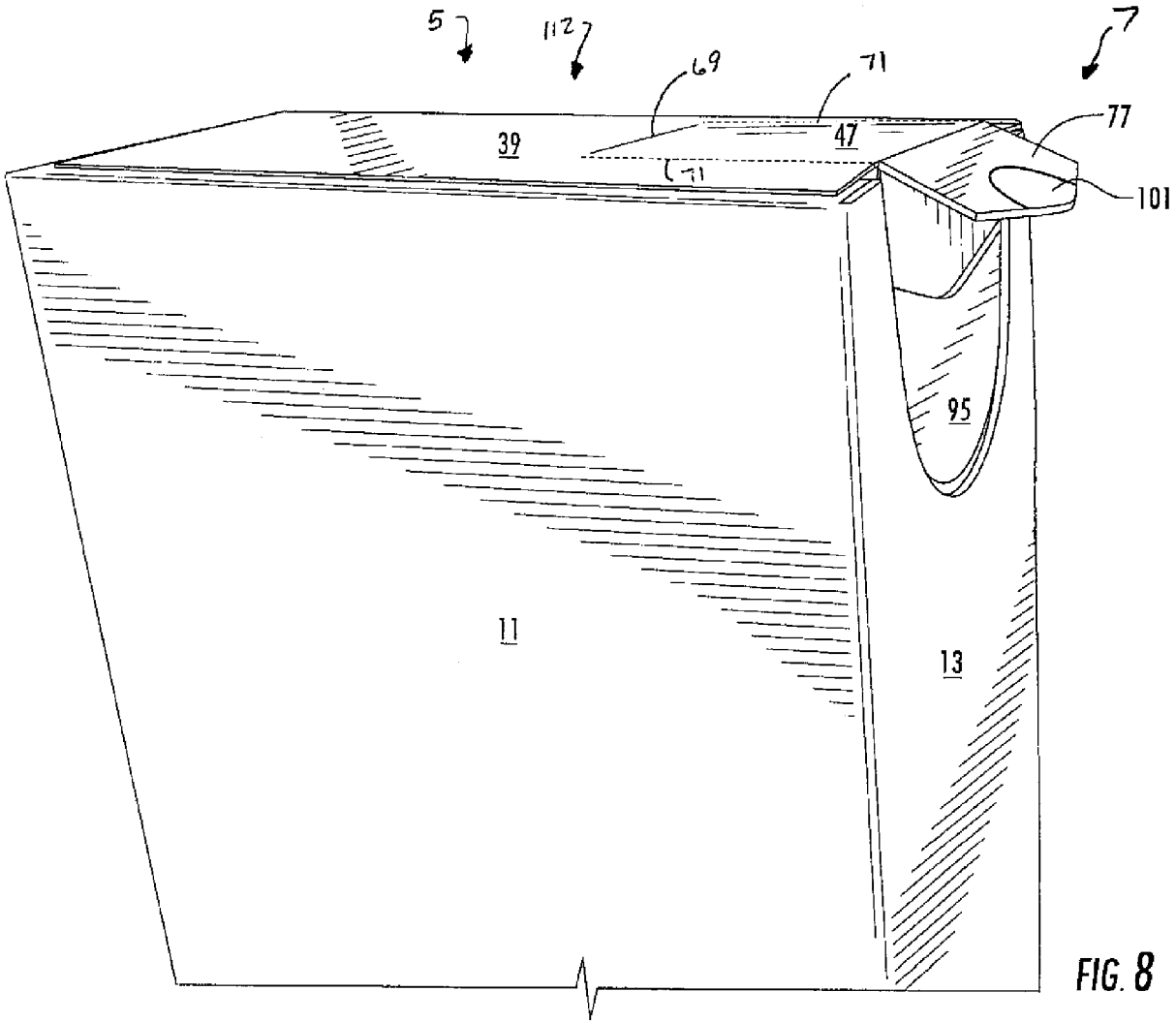
FIGS. 8-11 are various views showing the opener being moved from the closed position to an open position.

In one embodiment, the access flap 77 is foldably connected to the second hinge panel 85 at the longitudinal fold line 51. In one illustrated embodiment, the access flap 77 is removably connected to a slider panel 95 by a tear line 97. The main panel 81, hinge panels 83, 85, access flap 77, and slider panel 95 define the slidable opener 7 in the erected carton 5 (FIG. 7). The slidable opener 7 could be otherwise shaped, arranged, and/or configured without departing from the disclosure.

Figure 1A:
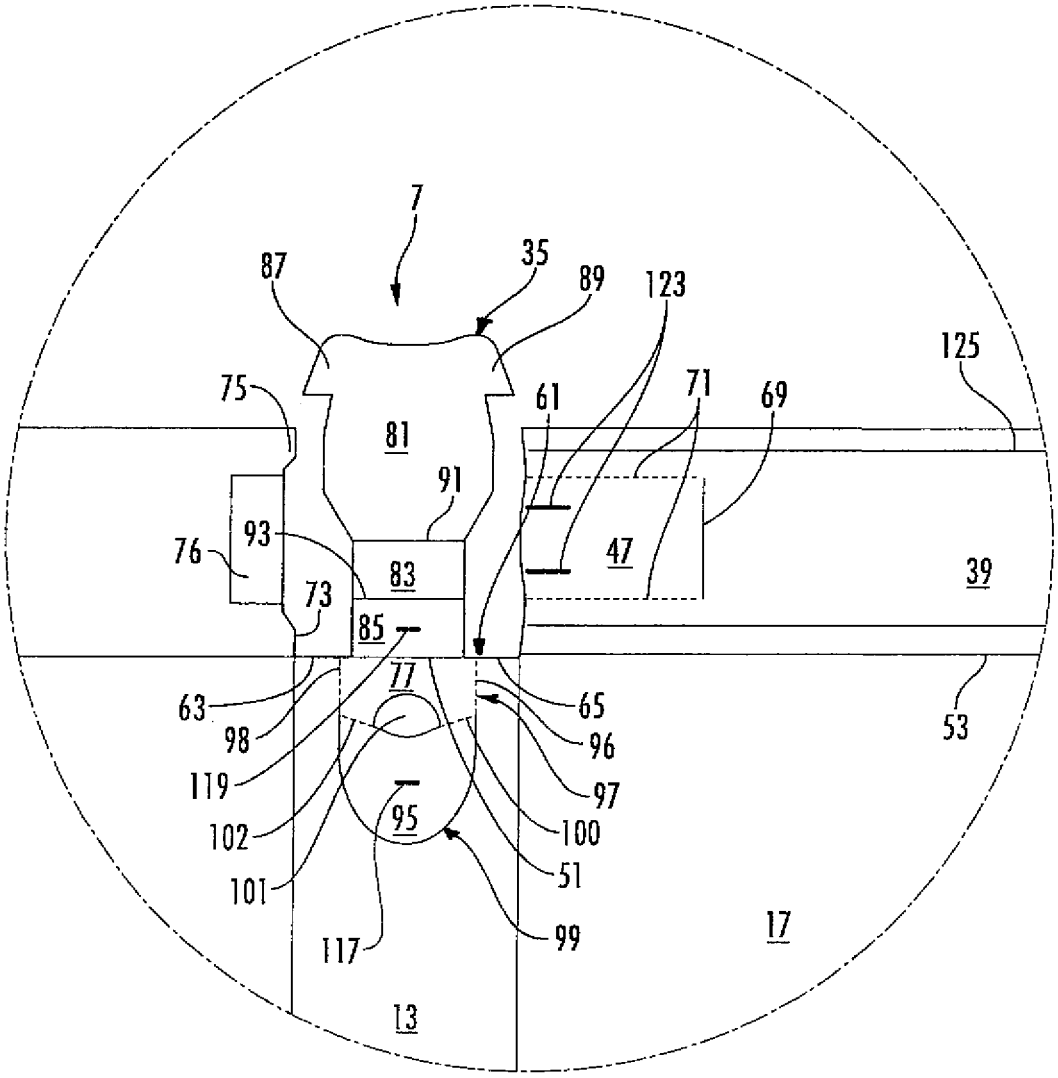
FIG. 1A is an enlarged portion of FIG. 1.

In the illustrated embodiment, the slider panel 95 is defined by a generally U-shaped line of weakening 99. The line of weakening 99 could be a cut line, a tear line, or any other form of weakening in the blank 3. The access flap 77 is defined by the tear line 97. As shown in FIG. 1A, the tear line 97 has lateral portions 96, 98 extending downwardly from respective portions 63, 65 of the top edge 61, and two oblique portions 100, 102 that extend from the lateral portions to the meet at the lowest portion of the access flap 77. The tear line 99 is generally U-shaped extending from the junction of the respective lateral portions and oblique portions of the tear line 97. The tear lines 97, 99 could be otherwise shaped, arranged, and/or configured, or either or both of the tear lines could be other forms of weakening (e.g., cut line), or a combination of tear line and cut line (e.g., a cut line having spaced-apart nicks), without departing from the disclosure. In one embodiment the access flap 77 has an embossed portion 101 that is defined by an arc-shaped fold line 104 at the lowermost portion of the access flap. The embossed portion 101 protrudes from the surface of the remaining portion of the access flap 77 and facilitates grasping of the access flap at the lowermost portion of the access flap and separation of the access flap from the end panel 13.

Figure 3:
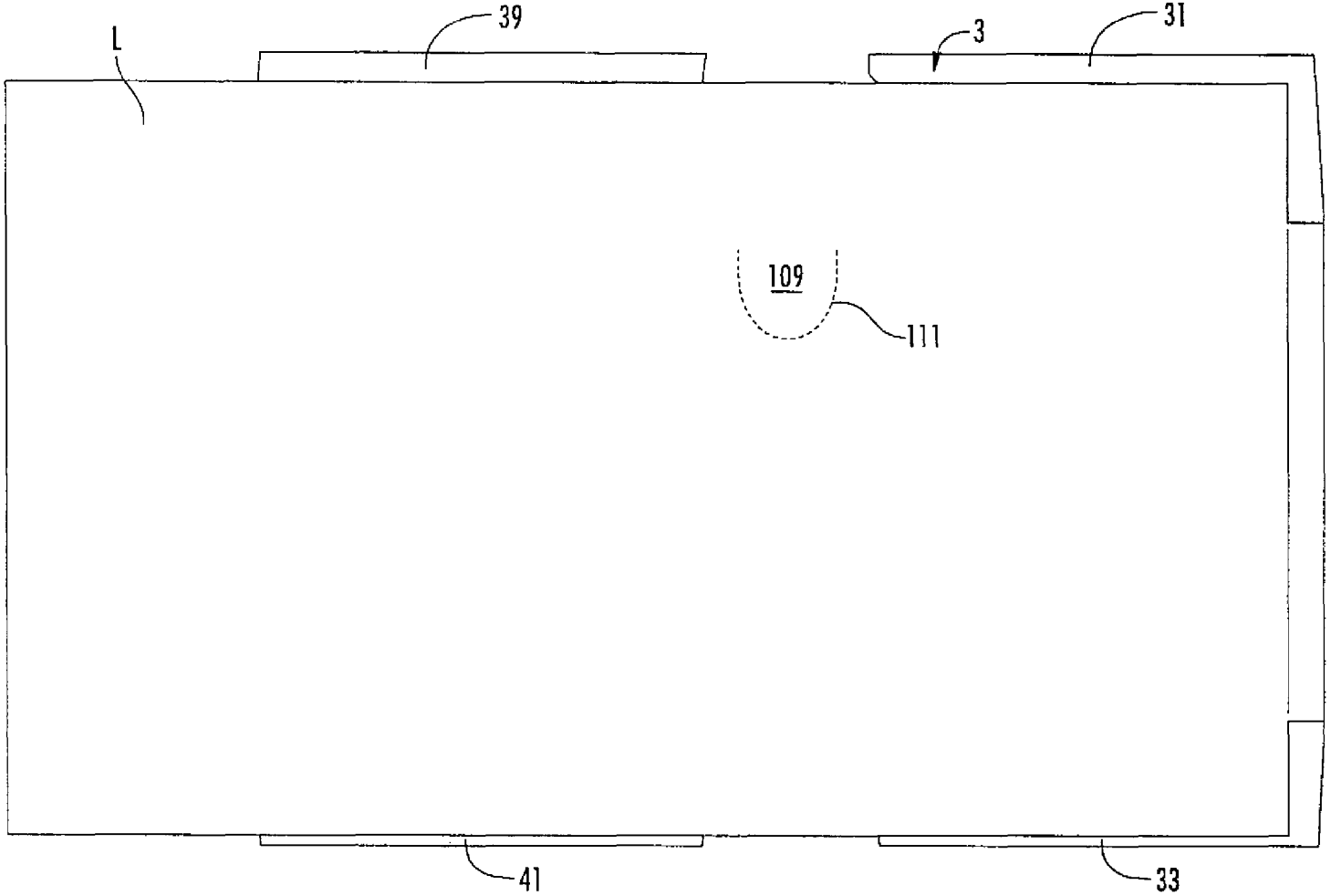
FIG. 3 is a plan view of an interior surface of the blank and the liner.
Figure 4:
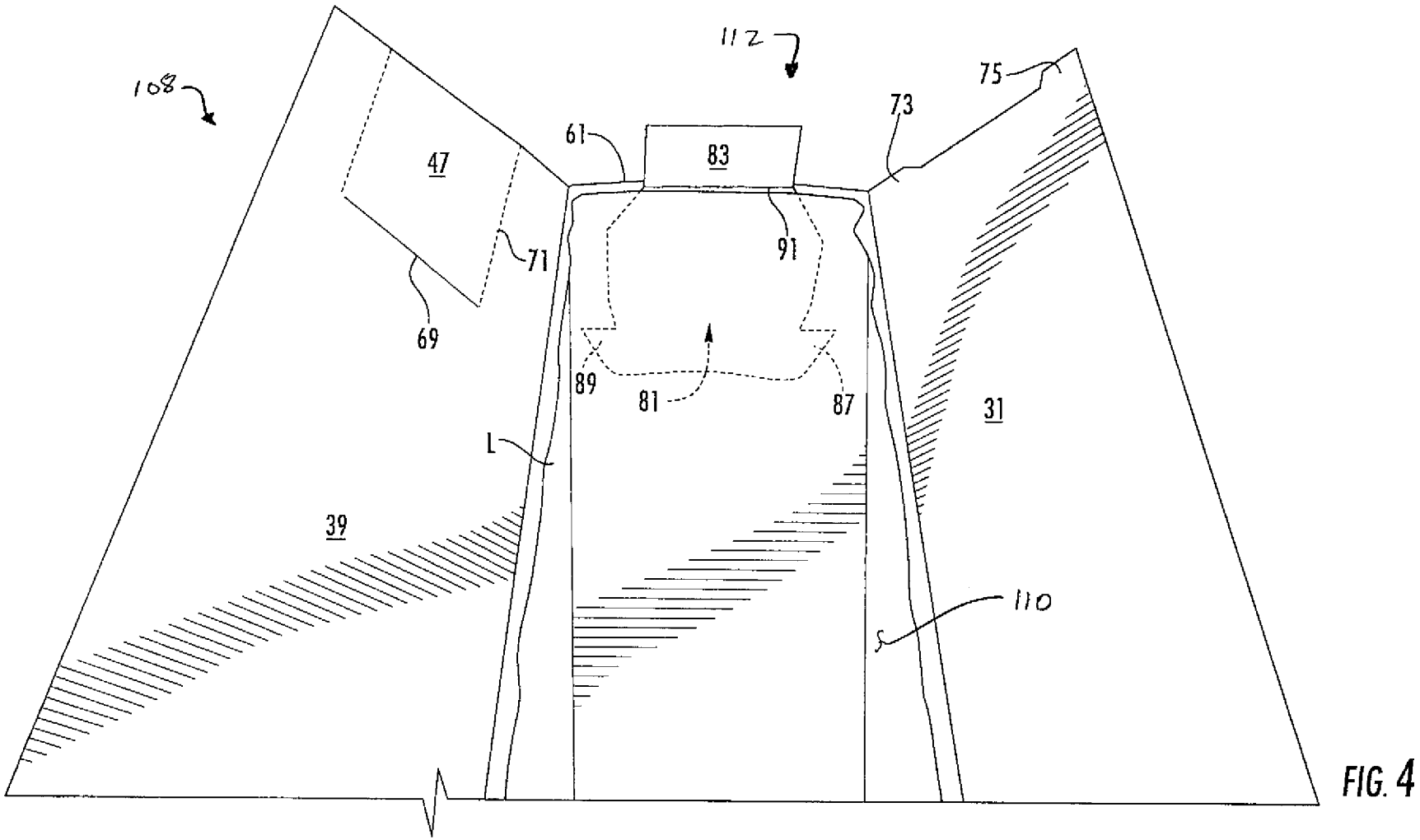
FIG. 4 is a top view of the partially formed carton of the first embodiment.

According to one exemplary method of construction, the carton 5 may be erected by folding the blank 3 about the transverse fold lines 19, 27 so that the exterior side of the adhesive panel 25 contacts the interior side of a marginal portion of the first side panel 11. The blank 3 is then folded about fold lines 15, 19, 23, 27 to from a generally open-ended sleeve 108 (FIG. 4). Prior to forming the open-ended sleeve 108, the liner L has been attached to the blank 3 by, for example, glue, adhesives, or other means. FIG. 3 is a view of an interior surface 2 of the blank 3 showing the liner L attached. The liner L can have one or more reinforcing layers or sections that can comprise a rigid material (e.g. paperboard) attached to the flexible material of the liner L. The first side panel 11 can be adhered to the adhesive panel 25 by, for example, glue, adhesives, or other means, so as to form the open-ended sleeve 108.

In one embodiment, the bottom of the partially erected carton 5 can be closed by folding the bottom end flaps 37, 45 inwardly, followed by folding the bottom end flap 33 and the bottom end flap 41. The interior surface of the bottom end flap 41 can be adhered to the exterior side of the bottom end flap 33. Portions of one or both of the bottom end flaps 33, 41 may also be adhered to the bottom end flaps 37, 45 without departing from the disclosure. The bottom of the carton 5 can be closed by otherwise positioning the end flaps 33, 37, 41, 45.

Products such as dispensable food products (not shown) may be placed in the interior space 110 of the partially formed carton 5. In one embodiment the food products can be placed in the interior side of the liner L, and the liner L can be adhered to the interior surface of the partially formed carton by, for example, glue, adhesives, or other means. As shown in FIG. 3, the liner L includes a dispenser panel 109 defined by a generally U-shaped tear line 111. The tear line 111 is generally aligned with the cut-line 99 that facilitates access to the interior portion of the carton 5. The liner L can be omitted from the carton 5 and blank 3 without departing from the disclosure.

Figure 2:
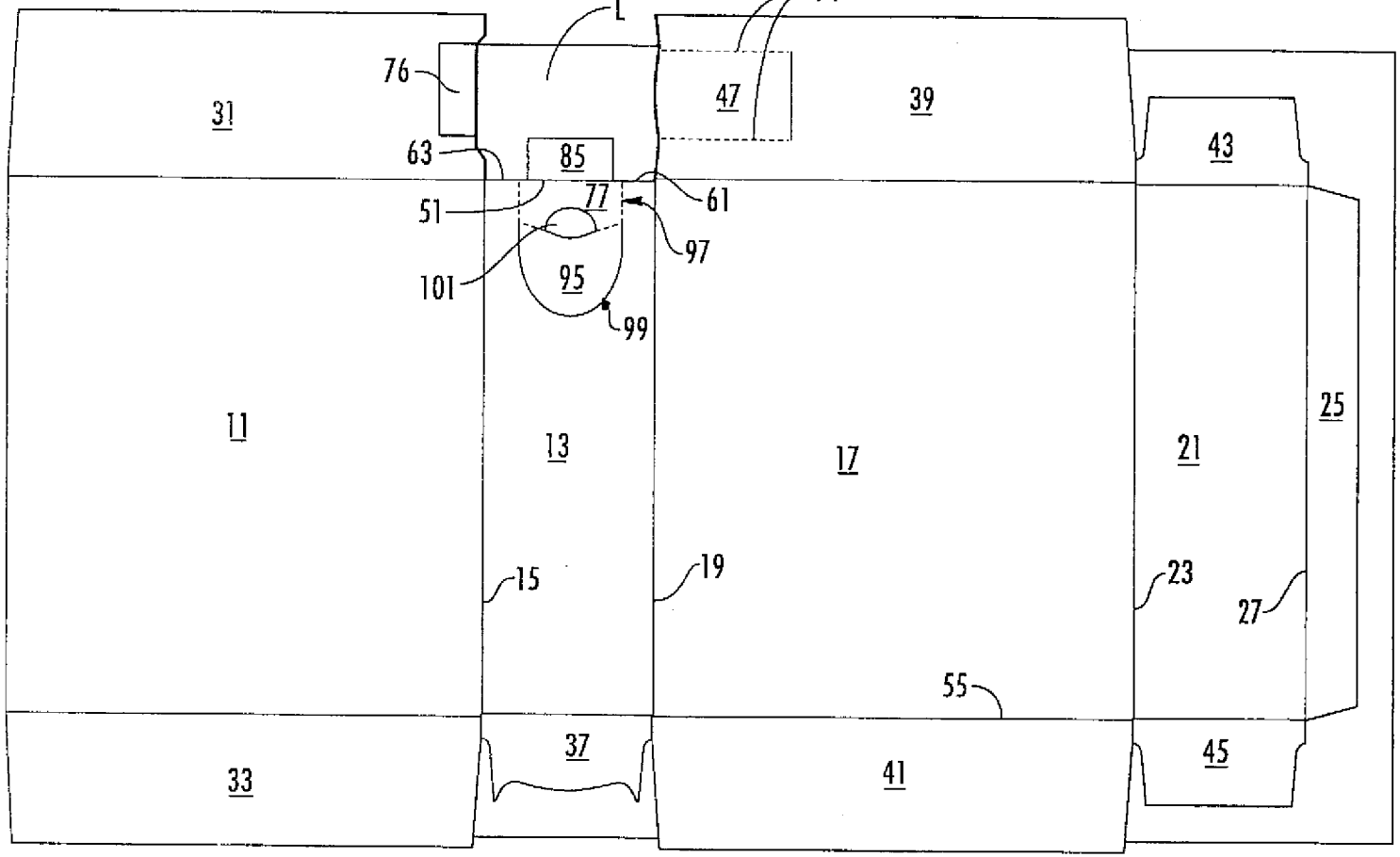
FIG. 2 is a plan view of the exterior surface of the blank of FIG. 1, the blank being partially formed into the carton and having a liner attached thereto.

In one embodiment, the top 112 (FIGS. 4-7) of the partially formed carton 5 can be closed by folding and at least partially overlapping the top end flaps 31, 39, 43, and forming the slidable opener 7. First, the slidable opener 7 is configured by folding the main panel 81 and the first hinge panel 83 downwardly about fold line 93 towards an interior of the carton 5. The main panel 81 is placed in face-to-face contact with the end panel 13 and is adhesively secured to the slide panel 95 by an adhesive such as glue 117 (FIG. 1A). The first hinge panel 83 is in face-to-face contact with the second hinge panel 85 and can be adhesively secured to the second hinge panel 85 by glue 119 (FIG. 1A). As shown in FIGS. 2 and 4, the overlapped and adhered hinge panels 83, 85 extend upwardly from the top edge 61 of the end panel 20.

Figure 5:
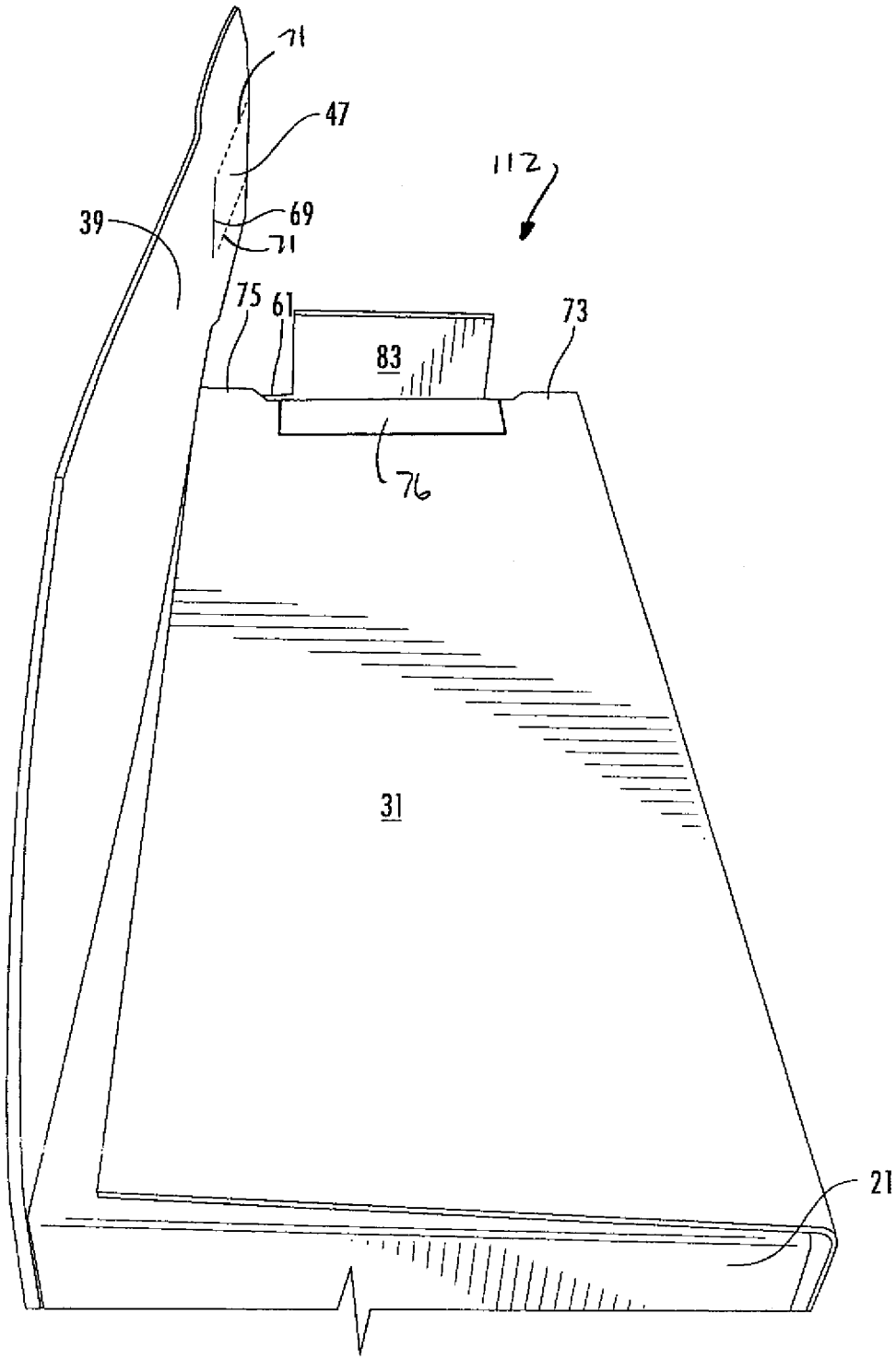
FIGS. 5 and 6 are top views of the carton of the first embodiment further formed.
Figure 6:
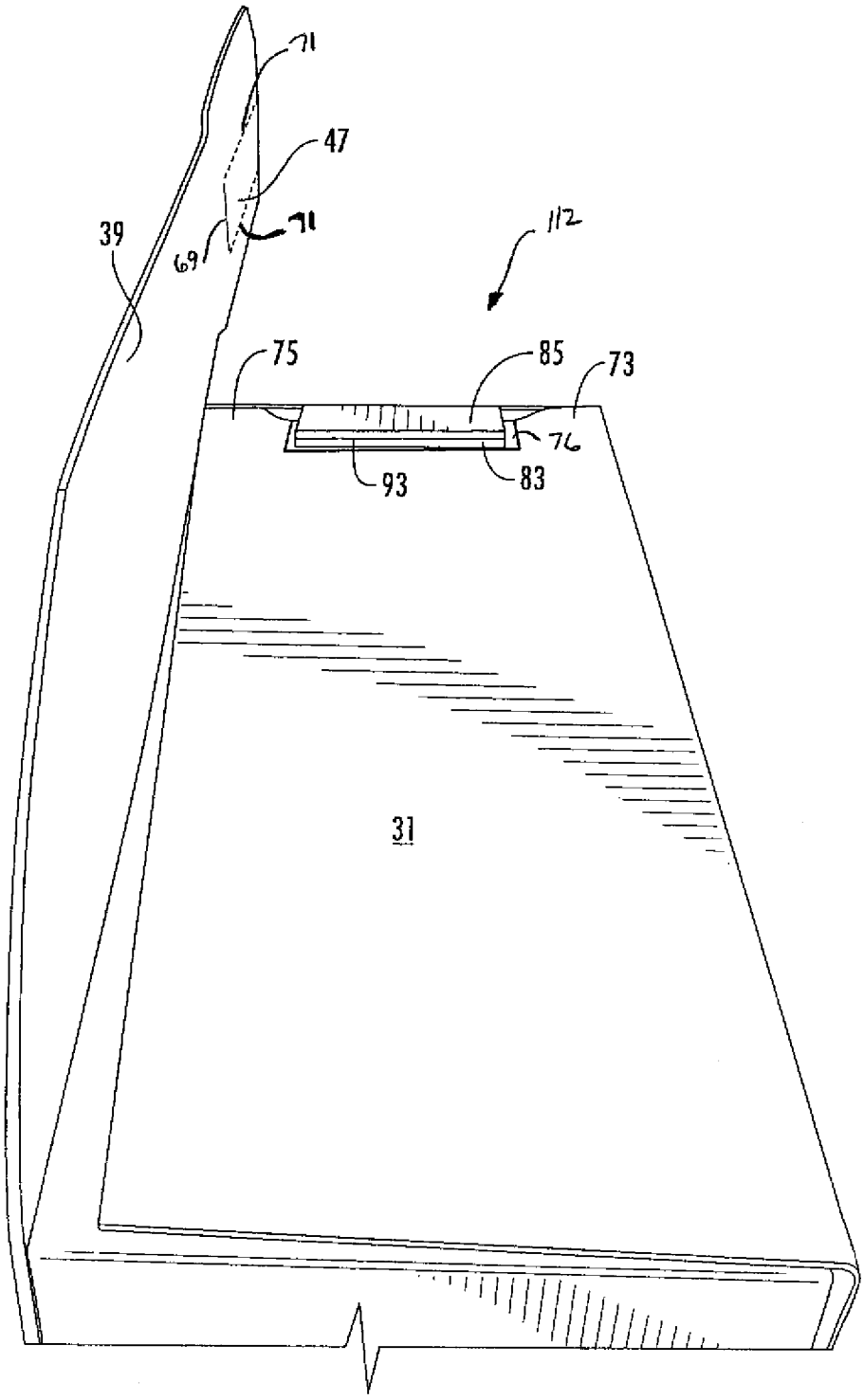

In one embodiment, the top end flap 43 is inwardly folded, and the top end flap 31 is folded over top of the flap 43 (FIG. 5). As shown in FIG. 6, the overlapped hinge panels 83, 85 are folded downward to be in face-to-face contact with the top end flap 31 such that the hinge panel 83 is in face-to-face contact with the debossed portion 76 of the top end flap 31. Next, the top end flap 39 is downwardly folded to be in face-to-face contact with the top end flap 31 and the overlapped hinge panels 83, 85. The interior side of top flap 39 can be adhesively secured to the exterior side of the flap 31 and the overlapped hinge panels 83, 85 by glue lines 123, 125, 127 (FIG. 1) or other adhesive. The hinge flap 47 in the top end flap 39 is adhesively connected to the overlapped hinge panels 83, 85 by the glue lines 123 (FIG. 1A). Adhesive other than glue can be used without departing from the scope of this disclosure. Further, the glue lines could be other shapes other than lines, or the glue lines could be otherwise configured without departing from the disclosure.

Figure 9:
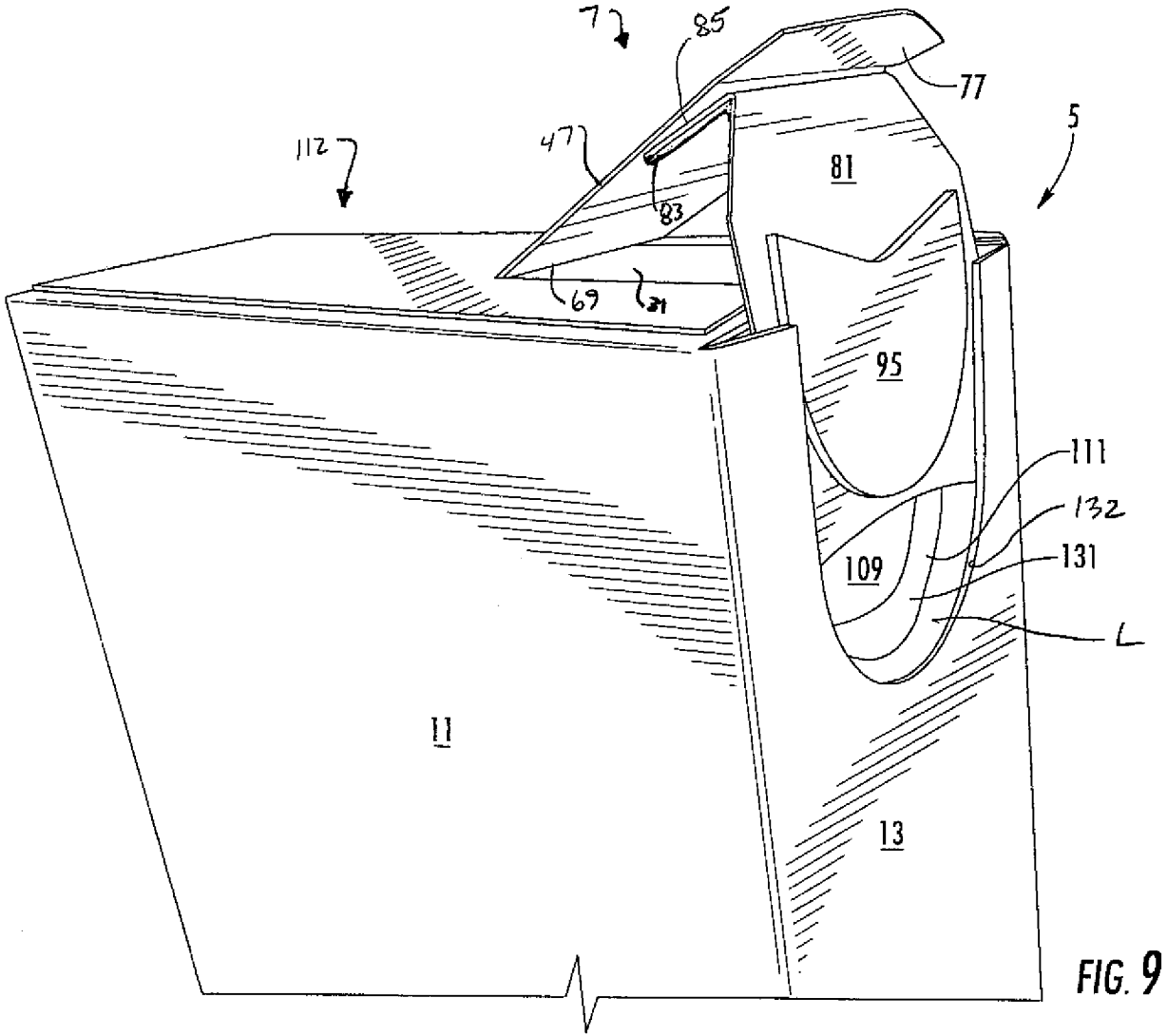
Figure 10:
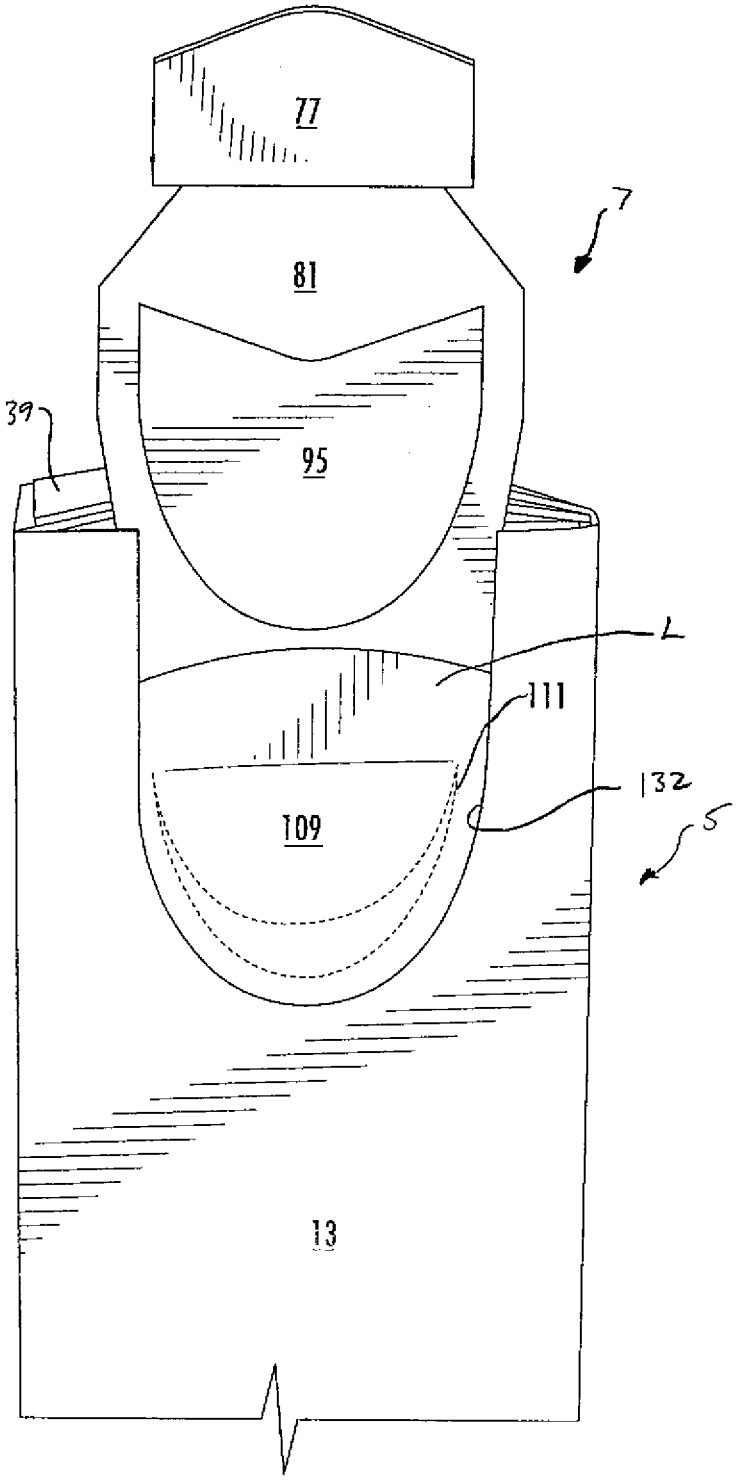
Figure 11:
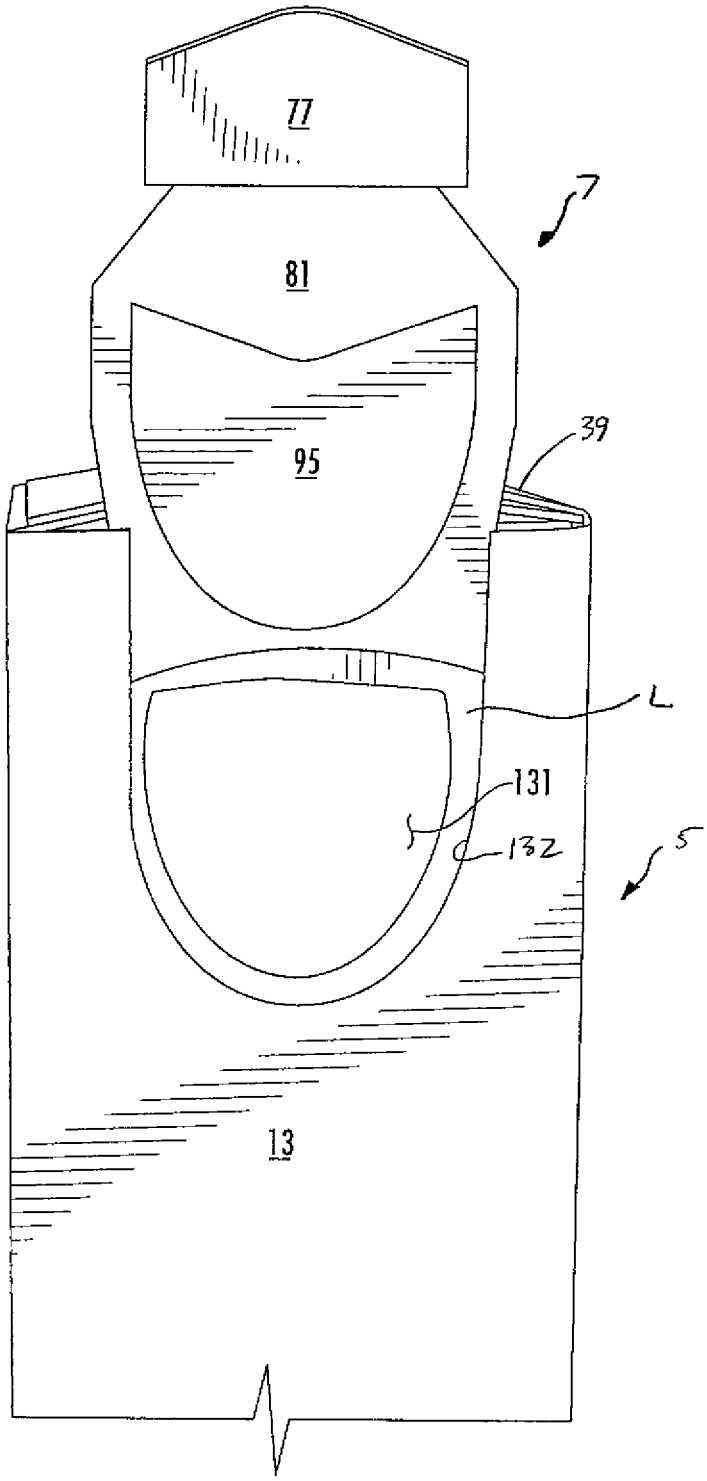

FIGS. 7-13 illustrate various stages of moving the slidable opener 7 from a closed position (FIG. 7) to an open position (FIGS. 9-11) in the erected carton 5, which is substantially parallelepipedal in shape. The slidable opener 7 is slidable between the closed position (FIGS. 7 and 8) and the open position (FIGS. 9-11) that allows food product held therein to be dispensed through a dispenser opening 131. To place the opener 7 in the open position the access flap 77 is first torn at tear line 97 by grasping at the embossed portion 101 and lifting the access flap so that the access flap 77 is free from attachment to slider panel 95 and the end panel 13. The access flap 77 is upwardly folded (FIG. 8) about fold line 51 and pulled upward to slide the main panel 81 upward to the open position (FIGS. 9-11). The slider panel 95 is attached to the main panel 81 and moves up and down with the sliding of the main panel. The main panel 81 slides along an internal side of the end panel 13 until the retention tabs 87, 89 abut the stop portions 73, 75 of the top end flaps 3. When the main panel 81 is moved upward to the open position (FIG. 9), the hinge panel 47 pivots upwardly at fold line 69 in the top end flap 39. Upon initial opening of the dispenser 7, the dispenser panel 109 of the liner L will have to be pushed inwardly to create the dispenser opening 131 (FIG. 11) of the carton 5. Product held in the carton 5 can be dispensed or poured from the carton in the open position of the opener 7 through the dispenser opening 131. The product may include, for example, dispensable foodstuffs, or other nonfood products such as detergent, powders, etc. In one embodiment, the dispenser opening 131 is formed by the opening in the end panel 13 caused by the removal of the slider panel 95 that is separated from the end panel, attached to the main panel 81, and raised with the main panel when the opener 7 is moved to the open position. Further, the dispenser opening 131 can be formed by inwardly folding the liner flap 109, if a liner L is provided on the interior of the carton 5.

Figure 12:
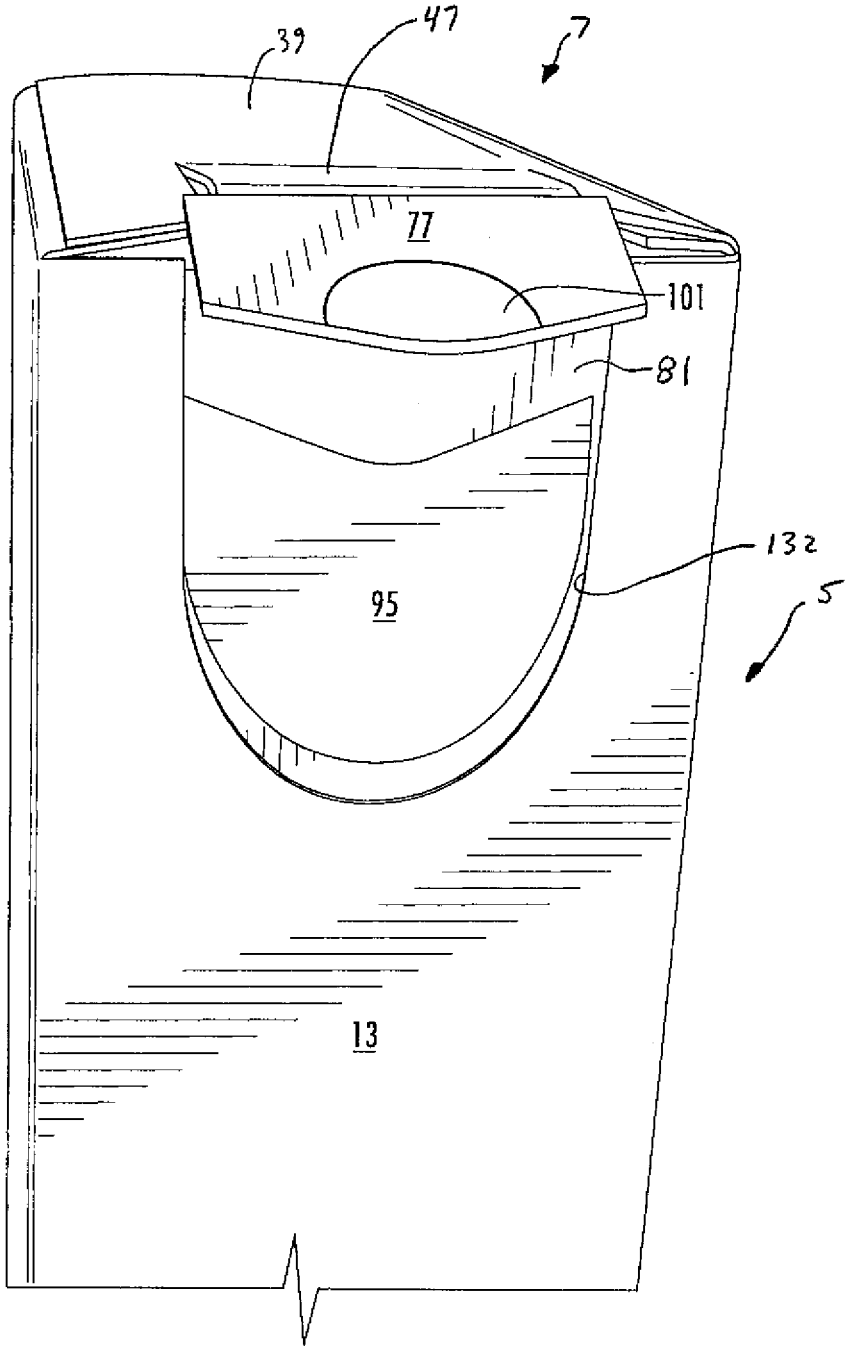
FIG. 12 is an end view showing the opener reclosed or returned to the closed position.

After removal of the product, the opener 7 can be reclosed by grasping the access flap 77 and then downwardly pulling access flap 77 so that the main panel 81 is slid downwardly to cover and close the dispenser opening 131 (FIG. 12). The access flap 77 and the hinge panel 47 can be folded downwardly and returned to the closed position (FIG. 7). In one embodiment, the slider panel 95 is positioned to be adjacent to the edge 132 created at the location of the U-shaped line of separation 99 in the end panel 13.

In one embodiment, the opener 7 can be reopened by pivoting the access flap 77 so that the access flap 77 is upwardly folded along fold line 51 and pulling the access flap 77 upwardly to raise the main panel 81 so that the dispenser opening 131 is again created in the end panel 13 in the manner as generally discussed above for the initial opening sequence of the slidable opener 7.

The opener 7 can be opened, reclosed, and reopened by various other steps or methods other than those described herein. Further, the steps of opening, reclosing, and reopening the dispenser described herein can be modified, changed, and/or omitted without departing from the disclosure.

The slidable opener 7 formed from the main panel 81, hinge panels 83, 85, access flap 77, and slider panel 95 allows the blank 3 and carton 5 to be made from a reduced amount of material (e.g., paperboard). The slidable opener 7 could be otherwise shaped, arranged, and/or configured without departing from the disclosure. Also, the access flap 77 that is initially secured to the end panel 13 by the tear line provides tamper evident indicator that shows that the carton 5 may have been tampered with if the carton is received or purchased by a consumer with the access flap 77 separated from the end panel 13 by tearing at tear line 97. Further, evidence of tampering with the carton 5 can be indicated by the access flap 77 being in an upwardly folded position. The carton may have other or different tamper evident features without departing from the disclosure.

Figure 13:
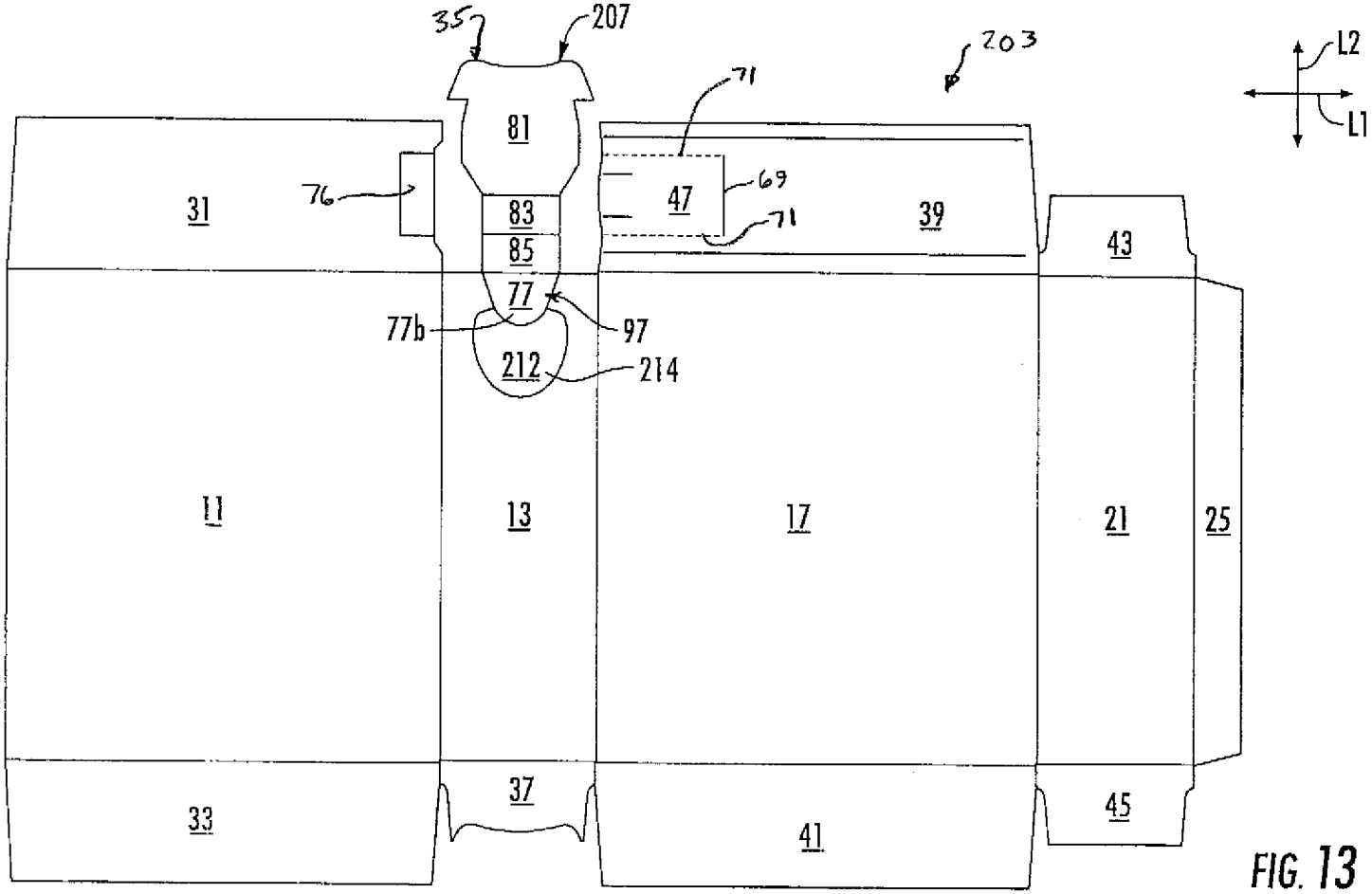
FIG. 13 is a plan view of an exterior surface of a blank for forming a carton of a second embodiment of the disclosure.
Figure 14:
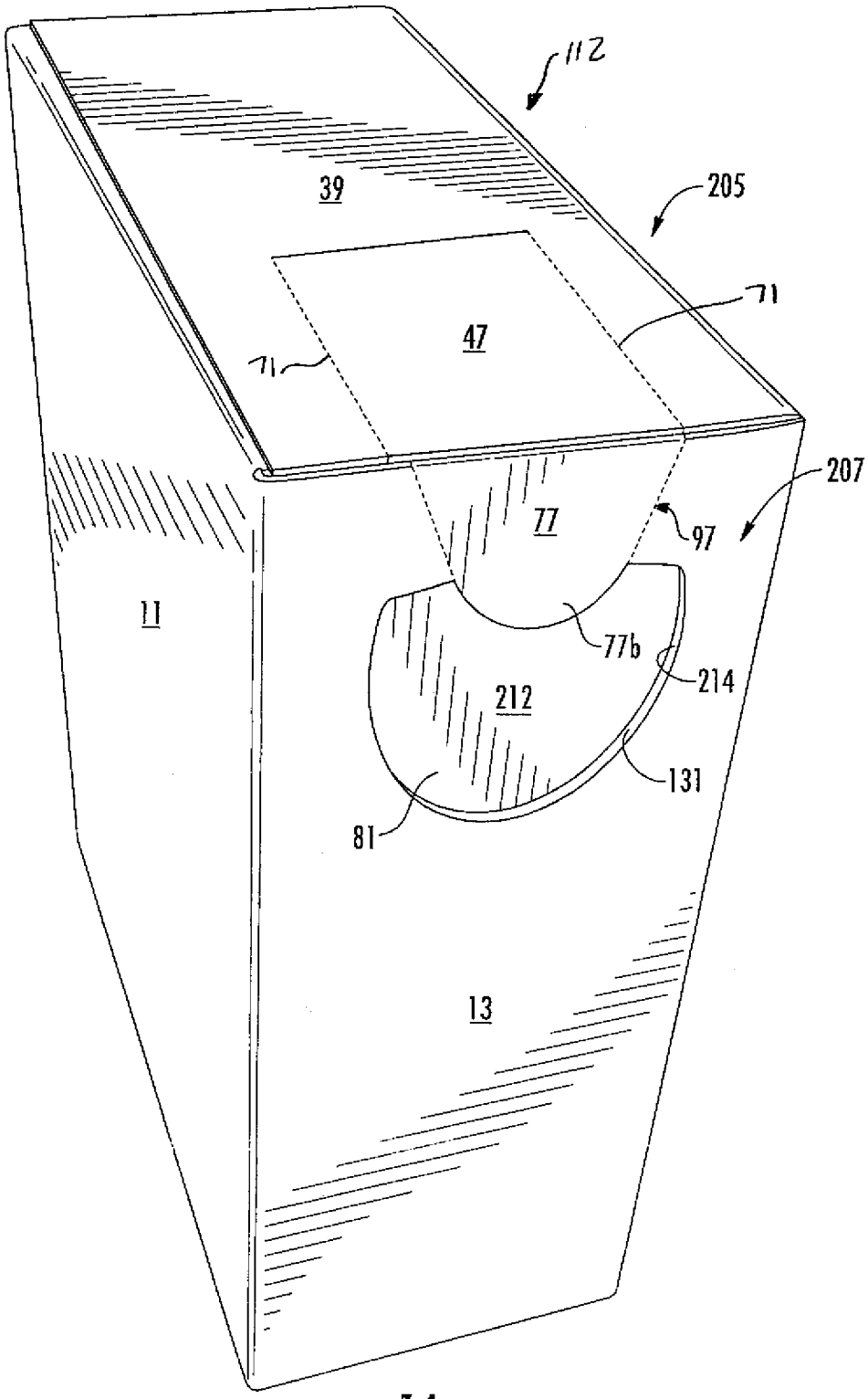
FIG. 14 is a top perspective view of the carton of the second embodiment with an opener in the closed position.

FIG. 13 illustrates a second embodiment of a blank 203 for forming a carton 205 (FIG. 14) with a slidable opener 207. The blank 203 of FIG. 13 has similar features as the blank 3 of the first embodiment, and like or similar reference numbers are used to indicate like or similar features. In the illustrated embodiment, the end panel 13 has an opening 212 that is adjacent the access flap 77. The opening 212 is defined by a curved edge 214 and a lower portion 77*b* of the access flap 77. The lower portion 77*b* of the access flap 77 extends into the opening 212. In the second embodiment, the slidable opener 207 is similar to the slidable opener 7 of the first embodiment, except that the slidable opener 207 has the opening 212 instead of the slider panel 95. The slidable opener 207 could be otherwise shaped, arranged, and/or configured without departing from the disclosure.

In one embodiment, the carton 205 of the second embodiment is formed in a substantially similar manner as described above for forming the carton 5 of the first embodiment. The carton 205 could have a liner L similar to the liner L of the first embodiment, or the liner L could be omitted without departing from the disclosure. The carton 205 could be formed by other or different forming steps without departing from the disclosure.

Figure 15:
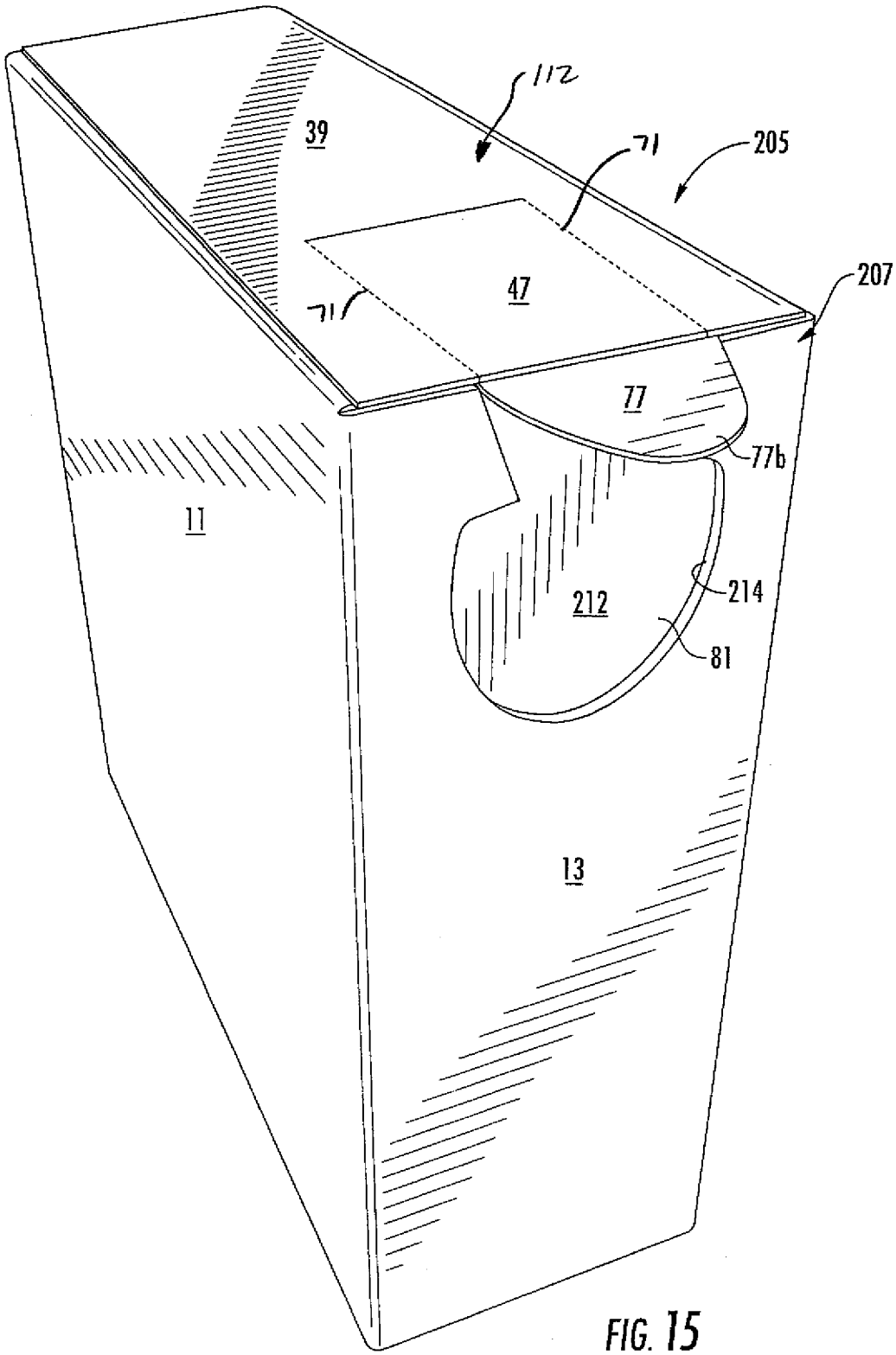
FIGS. 15-17 are various views showing the opener of the carton of the second embodiment being moved to the closed position.
Figure 16:
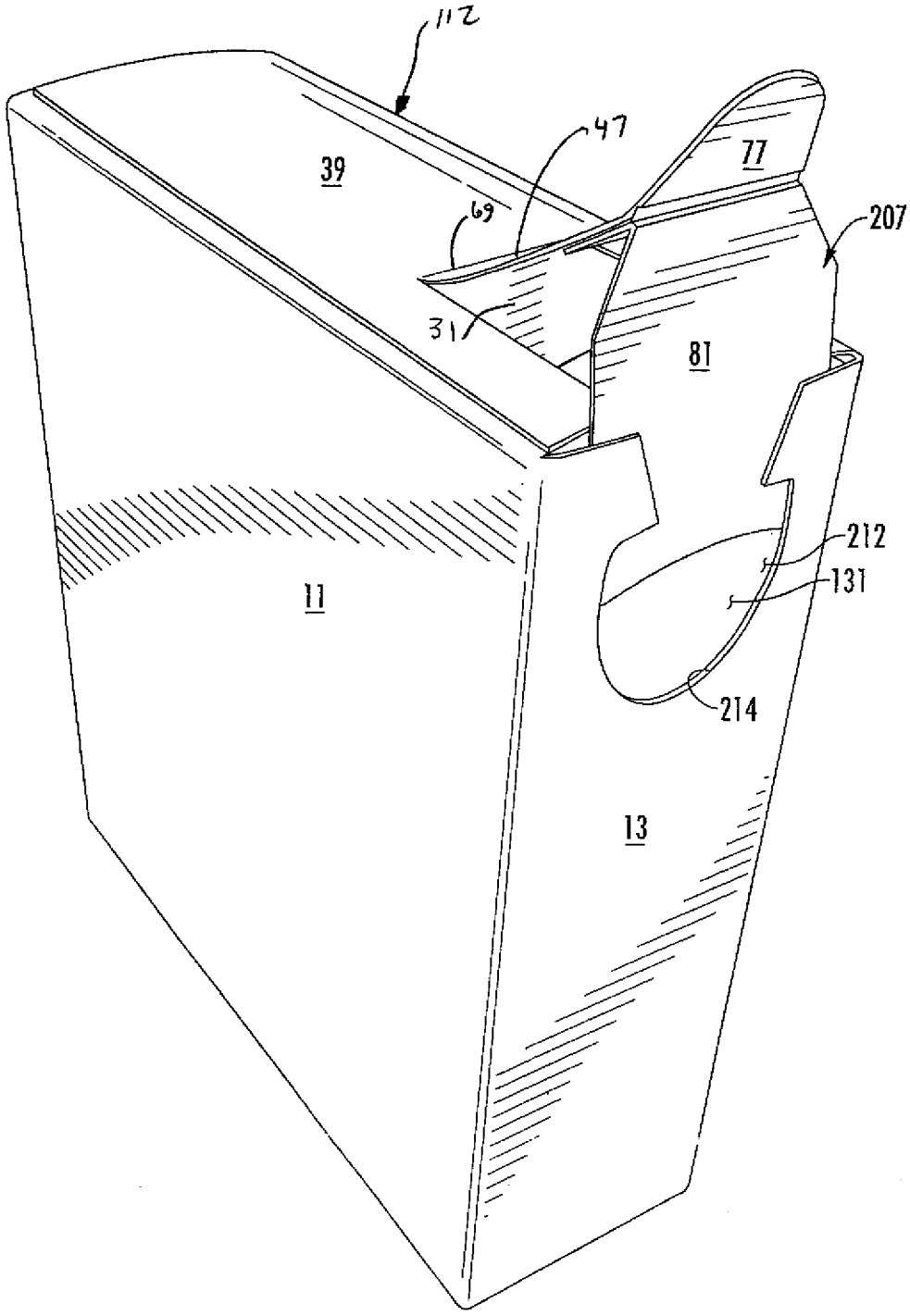
Figure 17:
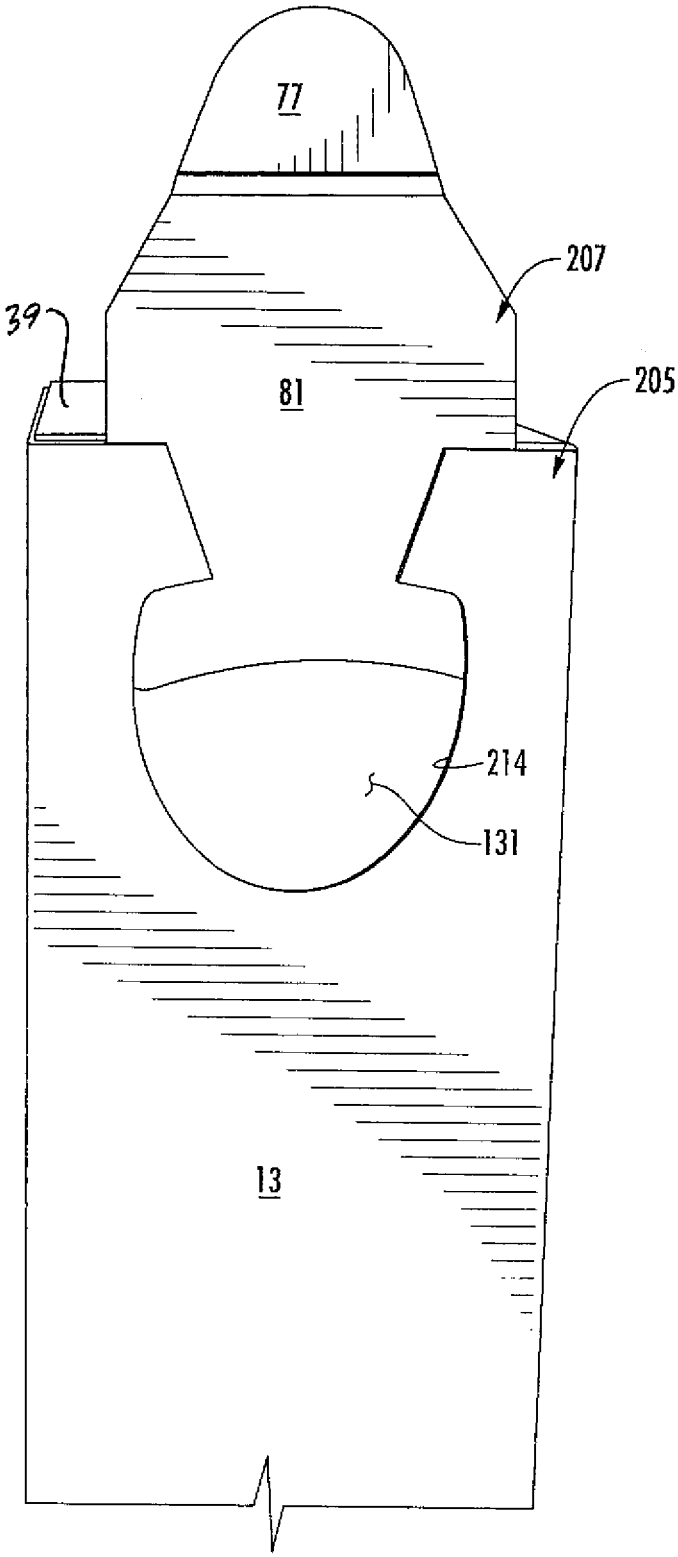

FIGS. 14-18 illustrate various stages of moving the slidable opener 207 from a closed position (FIG. 14) to an open position (FIGS. 16 and 17) that are similar to the steps described for the carton 5 of the first embodiment. As shown in FIG. 15, the opener can be actuated by grasping the distal portion 77*b* of the access flap 77 to separate the access flap 77 from the end panel 13 by tearing along tear line 97. As shown in FIG. 16, the access flap 77 is further raised to slide and raise the main panel 81 of the opener 207. As with the previous embodiments, the access flap 77 is operatively connected to the hinge flap 47 by way of the hinge panels 83, 85 so that the hinge flap 47 is raised when the opener 207 is positioned in the open position. When the main panel is raised, the opening 131 is exposed to allow material to be removed from the carton 205. In the second embodiment, the dispenser opening 131 is formed by the opening 212 in the end panel 13 and an opening in the liner L formed by inwardly folding the liner flap 109, if a liner is provided on the interior of the carton 205.

As with the previous embodiment, the opener 207 can be returned to the closed position (FIG. 14) wherein the main panel 81 is slid downward to substantially cover the opening 212 in the end panel 13 to prevent the flow of material from the carton 205. The opener 207 can be moved between the open and closed position by other or different steps without departing from the scope of the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels, flaps, or features, adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a product, the carton comprising:

a plurality of panels that extends at least partially around an interior of the carton, the plurality of panels comprises a first end panel, a first side panel, a second end panel, and a second side panel;

at least one end flap respectively foldably connected to a respective panel of the plurality of panels, the at least one end flap at least partially forming a closed end of the carton;

an opener that is positionable between a closed position substantially preventing removal of the product from the interior of the carton through a dispenser opening in one of the first end panel and the second end panel, and an open position allowing removal of the product from the interior of the carton through the dispenser opening, the at least one end flap comprises a main panel that is slidably positioned adjacent the one of the first end panel and the second end panel, the main panel being positionable between a lower position corresponding to the closed position of the opener and a raised position corresponding to the opened position of the opener, the first end panel comprises a portion having an access flap foldably connected to the at least one end flap, the access flap is separable from the one of the first end panel and the second end panel and moveable with the main panel, and the at least one end flap comprises a first hinge panel foldably connected to the main panel and a second hinge panel foldably connected to the first hinge panel and the access flap.

2. The carton of claim 1 wherein the opener comprises the at least one end flap and a portion of the first end panel, the at least one end flap is foldably connected to the one of the first end panel and the second end panel.

3. The carton of claim 1 wherein the at least one end flap comprises a first end flap foldably connected to the one of the first end panel and the second end panel, and a second end flap foldably connected to one of the first side panel and the second side panel.

4. The carton of claim 3 wherein the opener comprises a hinge flap that is foldably connected to the second end flap, the hinge flap operatively connected to at least one of the first hinge panel and the second hinge panel.

5. The carton of claim 4 wherein the at least one end flap further comprises a third end flap foldably connected to the other of the first side panel and the second side panel, the main panel has at least one retention tab and the third end flap has at least one stop portion for restraining upward movement of the main panel by contact with the at least one retention tab.

6. The carton of claim 1 wherein the access flap is adjacent a slider panel that is separable from the one of the first end panel and the second end panel at a tear line, the access flap is operatively attached to the main panel.

7. The carton of claim 6 wherein the dispenser opening at least partially comprises an opening in the one of the first end panel and the second end panel that is at least partially shaped by the tear line.

8. The carton of claim 1 wherein the access flap is adjacent an opening in the one of the first end panel and the second end panel, the dispenser opening at least partially comprises the opening in the one of the first end panel and the second end panel.

9. The carton of claim 1 further comprising a liner on the interior surface of the carton, the dispenser opening further comprising an opening in the liner that is aligned with an opening in the one of the first end panel and the second end panel.

10. A blank for forming carton for containing a product, the blank comprising:

a plurality of panels comprising a first end panel, a first side panel, a second end panel, and a second side panel;

at least one end flap respectively foldably connected to a respective panel of the plurality of panels, the at least one end flap being for at least partially forming a closed end of the carton formed from the blank;

opening features for forming an opener in the carton formed from the blank, the opener being positionable between a closed position substantially preventing removal of the product from carton through a dispenser opening in one of the first end panel and the second end panel, and an open position allowing removal of the product from the interior of the carton through the dispenser opening, the at least one end flap comprises a main panel that is for being slidably positioned adjacent the one of the first end panel and the second end panel, the main panel being positionable between a lower position corresponding to the closed position of the opener and a raised position corresponding to the opened position of the opener, the first end panel comprises a portion having an access flap foldably connected to the at least one end flap, the access flap is separable from the one of the first end panel and the second end panel, and the at least one end flap comprises a first hinge panel foldably connected to the main panel and a second hinge panel foldably connected to the first hinge panel and the access flap.

11. The blank of claim 10 wherein the opening features comprise the at least one end flap and a portion of the first end panel, the at least one end flap is foldably connected to the one of the first end panel and the second end panel.

12. The blank of claim 10 wherein the at least one end flap comprises a first end flap foldably connected to the one of the first end panel and the second end panel, and a second end flap foldably connected to one of the first side panel and the second side panel, wherein the opening features comprise a hinge flap that is foldably connected to the second end flap, the hinge flap is for being operatively connected to at least one of the first hinge panel and the second hinge panel in the carton formed from the blank.

13. The blank of claim 12 wherein the at least one end flap further comprises a third end flap foldably connected to the other of the first side panel and the second side panel, the main panel has at least one retention tab and the third end flap has at least one stop portion for restraining upward movement of the main panel by contact with the at least one retention tab in the carton formed from the blank.

14. The blank of claim 10 wherein the access flap is adjacent a slider panel that is separable from the one of the first end panel and the second end panel at a tear line, the access flap is attached to the main panel in the carton formed from the blank and the dispenser opening at least partially comprises an opening in the one of the first end panel and the second end panel that is at least partially shaped by the tear line.

15. The blank of claim 10 wherein the access flap is adjacent an opening in the one of the first end panel and the second end panel, the dispenser opening at least partially comprises the opening in the one of the first end panel and the second end panel.

16. The blank of claim 10 further comprising a liner on the interior surface of the blank, the liner comprising a tear line for forming an opening in the liner, the dispenser opening comprising the opening in the liner that is aligned with an opening in the one of the first end panel and the second end panel in the carton formed from the blank.

17. A method of forming a carton, the method comprising:

obtaining a blank comprising a plurality of panels comprising a first end panel, a first side panel, a second end panel, and a second side panel, at least one end flap respectively foldably connected to a respective panel of the plurality of panels, and opening features for forming an opener in the carton formed form the blank, the opening features comprising a dispenser opening in one of the first end panel and the second end panel, the at least one end flap comprises a main panel that is for being slidably positioned adjacent the one of the first end panel and the second end panel, the main panel being positionable between a lower position corresponding to the closed position of the opener and a raised position corresponding to the opened position of the opener, the first end panel comprises a portion having an access flap foldably connected to the at least one end flap, the access flap is separable from the one of the first end panel and the second end panel and moveable with the main panel, and the at least one end flap comprises a first hinge panel foldably connected to the main panel and a second hinge panel foldably connected to the first hinge panel and the access flap;

forming an interior of the carton at least partially defined by the plurality of panels;

positioning the at least one end flap to at least partially close an end of the interior and to at least partially form the opener from the opening features, the opener being positionable between a closed position substantially preventing removal of the product from carton through the dispenser opening in one of the first end panel and the second end panel, and an open position allowing removal of the product from the interior of the carton through the dispenser opening.

18. The method of claim 17 wherein the opening features comprise the at least one end flap and a portion of the first end panel, the at least one end flap is foldably connected to the one of the first end panel and the second end panel.

19. The method of claim 17 wherein the at least one end flap comprises a first end flap foldably connected to the one of the first end panel and the second end panel, and a second end flap foldably connected to one of the first side panel and the second side panel, wherein the opening features comprise a hinge flap that is foldably connected to the second end flap, the forming the opener comprises operatively connecting the hinge flap to at least one of the first hinge panel and the second hinge panel in the carton formed from the blank.

20. The method of claim 19 wherein the at least one end flap further comprises a third end flap foldably connected to the other of the first side panel and the second side panel, the main panel has at least one retention tab and the third end flap has at least one stop portion, the forming the opener comprises positioning the stop portion for restraining upward movement of the main panel by contact with the at least one retention tab.

21. The method of claim 17 wherein the access flap is adjacent a slider panel that is separable from the one of the first end panel and the second end panel at a tear line, the forming the opener comprises attaching the access flap to the main panel and forming the dispenser opening comprises forming an opening in the one of the first end panel and the second end panel by moving the slider panel with the main panel.

22. The method of claim 17 wherein the access flap is adjacent an opening in the one of the first end panel and the second end panel, the dispenser opening at least partially comprises the opening in the one of the first end panel and the second end panel.

23. The method of claim 17 further comprising attaching a liner to the interior surface of the blank, the liner comprising a tear line for forming an opening in the liner, the dispenser opening comprising the opening in the liner that is aligned with an opening in the one of the first end panel and the second end panel.

* * * * *